United States Patent [19]

DeCoster

[11] Patent Number: 4,723,693

[45] Date of Patent: Feb. 9, 1988

[54] DOUBLE HINGING CAP

[75] Inventor: Pieter K. J. DeCoster, Aalst, Belgium

[73] Assignee: Dart Industries, Inc., Deerfield, Ill.

[21] Appl. No.: 914,913

[22] Filed: Oct. 2, 1986

[51] Int. Cl.[4] ..... B65D 43/24

[52] U.S. Cl. ..... 222/483; 222/142.7; 222/480; 222/545; 220/335

[58] Field of Search ..... 215/235; 220/335; 222/142.6, 142.7, 153, 478, 480, 482–483, 485, 498, 517, 544, 545, 556, 565

[56] References Cited

U.S. PATENT DOCUMENTS

| | | | |
|---|---|---|---|
| 3,140,019 | 7/1964 | Barr | 222/480 |
| 3,217,949 | 11/1965 | Davis | 222/480 |
| 3,262,606 | 7/1966 | Waterman | 222/153 |
| 4,291,818 | 9/1981 | Nozawa et al. | 220/335 |
| 4,369,901 | 1/1983 | Hidding | 222/480 |

*Primary Examiner*—Joseph J. Rolla
*Assistant Examiner*—Michael S. Huppert
*Attorney, Agent, or Firm*—Russell L. McIlwain

[57] ABSTRACT

A container cap including dual longitudinally aligned closure lids integrally connected by an inboard hinge strip having a central mounting panel and opposed hinges integrally joining the hinge strip to the respective lids. A pair of outboard spring strips parallel the hinge strip in spaced relation to each side thereof, each spring strip including a substantially rigid central panel and opposed end hinges integrally joining the spring strip to the opposed lids on axes longitudinally outwardly spaced from the axes of the hinge strip hinges.

13 Claims, 13 Drawing Figures

DOUBLE HINGING CAP

BACKGROUND OF THE INVENTION

The invention is generally concerned with the packaging and dispensing of flowable material, and more particularly relates to a cap construction which allows for selective and controlled access to and discharge of material through independently manipulable closure elements with cooperating components.

In the dispensing of a wide range of flowable products, for example flour, grated cheese, spices, and the like, is frequently desirable to provide for both a sprinkling discharge of the material and a bulk discharge thereof. This is accommodated by the provision of selectively accessible discharge ports, one of which may consist of a plurality of small sprinkling apertures, and another which may include one single enlarged opening through which the material can be poured or spoon fed.

In order to accommodate such diverse selectively usable discharge ports, it is known to provide a cap rotatably mounted on the container for a selective exposure of the ports.

Alternatively, the cap may incorporate dual closures or lids, each associated with a different port and selectively movable to expose the port. An example of such a construction will be noted in the spice container of Hidding, U.S. Pat. No. 4,369,901, issued Jan. 25, 1983. In Hidding, each of the closure elements is separately hingedly or pivotally mounted and includes a protuberance which snap-locks into a niche. A separate protuberance and niche combination is provided for each of the closure elements to selectively lock the closure elements in an open position.

A similar cover or cap with multiple pivoted closure elements will also be seen in U.S. Pat. No. Des. 200,270, issued to Waterman on Feb. 9, 1965.

Such covers, as suggested in the Hidding patent, will advantageously be fabricated as a unitary structure from a suitable, molding grade thermoplastic resin, such as polyethylene, the particular nature of the material allowing for the formation of integral hinges along grooves or areas of reduced thickness formed therein. The formation of hinges in this manner is well known and will also be noted in the following patents:

| | | |
|---|---|---|
| 3,289,877 | Wolf | December 6, 1966 |
| 3,629,901 | Wolf | December 28, 1971 |
| 4,457,458 | Heinol | July 3, 1984 |

SUMMARY OF THE INVENTION

The double hinging cap of the present invention provides for dual independently manipulable closures or closure elements having shared components common to both closures and cooperatively arranged therewith to provide for a positive positioning and retention of each closure in either the open or closed position thereof.

The shared components, in the specific operation thereof, differ in accord with the particular closure being manipulated. In each instance, these shared components are closure positioning components which, through an overcenter alignment action, will selectively bias either closure in either the open or closed position thereof until a specific manual displacement of the closure to the other position. No mechanical interlock, for example of the type requiring engagement of protrusions within niches, is required. Rather, a pair of common or shared positioning strips, each provided with a pair of cooperating hinges, are jointly utilized by the two closure elements for the selective retention of either closure element upon a manual manipulation of the particular closure element. The arrangement of the positioning strips are such as to provide for the duplicating of the function thereof for sharing by the two closure elements, without necessitating duplicate structure.

Basically, the cap of the invention includes a pair of longitudinally aligned closures or lids each hingedly secured, by a separate transverse integral or living hinge, to a central hinge plate. The hinge plate and associated hinges define an inboard hinge strip integrally joining the closures or lids. Immediately outboard of the hinge strip, to each side thereof and spaced therefrom by narrow slots, are a pair of parallel outboard spring or positioning strips, each also joining the closures or lids. Each of the positioning strips includes a central panel which, at the opposite longitudinal ends thereof, is integrally joined to the opposed closures or lids by a pair of outboard hinges paralleling the inboard hinges in longitudinally outwardly spaced relation thereto.

The outboard positioning strips are defined in a plane parallel to and laterally spaced below the plane of the hinge strip and are formed in a manner whereby a stable relationship is effected upon a horizontal orientation and alignment of the closures hinge strip and positioning strips. Upon a raising of either of the closures or lids, through a pivoting thereof about the hinge joining the chosen closure to the hinge plate, both positioning strips will be subjected to tension with the corresponding hinges, proximal the closure being manipulated, folding in accord with the primary closure hinge and, through a related pivoting of the remote positioning strip hinges, moving upwardly to an overcenter position above the primary hinge. As the proximal positioning strip hinges move overcenter beyond the primary hinge, the inherent resilient memory thereof, and the release of manual pressure on the manipulated closure, will result in a tendency for the positioning strips to contract and fix the manipulated closure in its moved or open position. Such action will be duplicated, with the function of the corresponding hinges reversing, upon manipulation of the other closure.

Other features and advantages of the invention will become apparent as the details of the construction and manner of use of the invention are more fully hereinafter described.

DESCRIPTION OF PREFERRED EMBODIMENT

Figure 1:
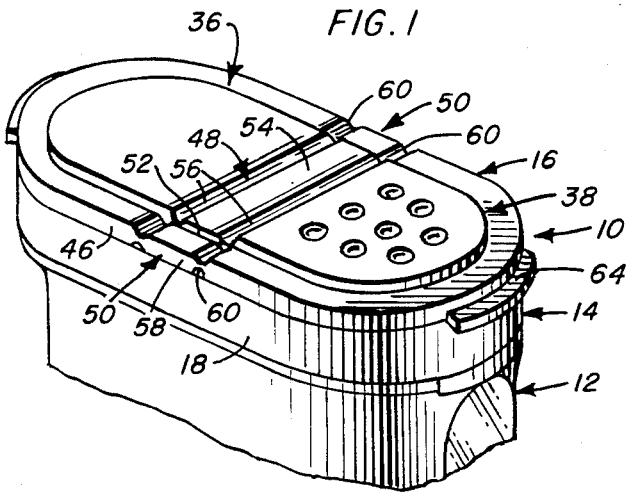
FIG. 1 is a perspective view of the upper portion of a container with the cap of the present invention mounted thereon.
Figure 2:
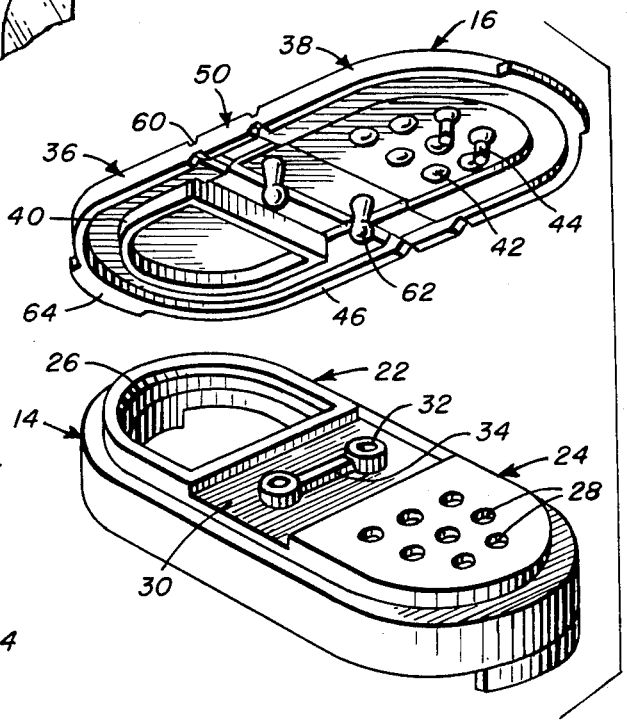
FIG. 2 is an exploded perspective view of the cap and an associated container seal to which the cap cooperatively mounts.
Figure 3:
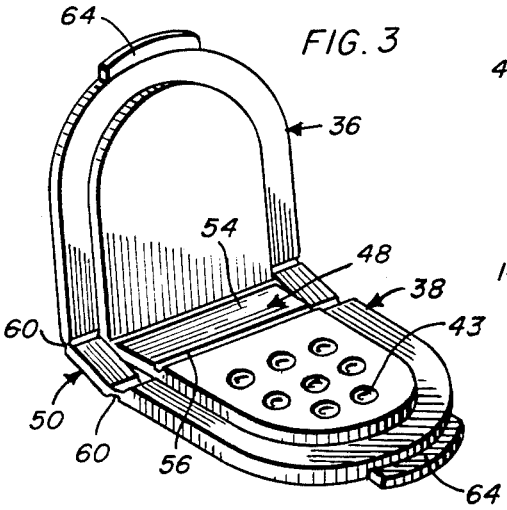
FIG. 3 is a perspective view of the cap with one closure thereof pivoted upward into its open position.
Figure 4:
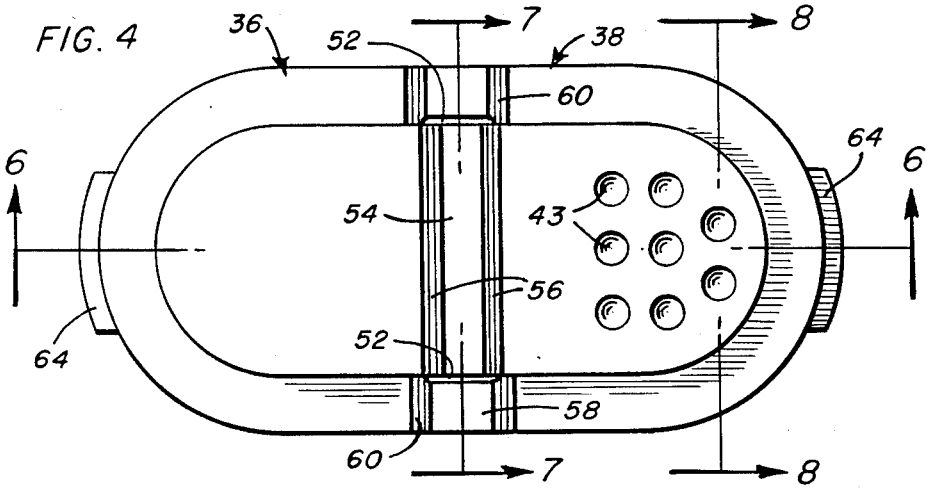
FIG. 4 is a top plan view of the container mounted cap.

Referring now more specifically to the drawings, reference numeral 10 is used to generally designate a package for flowable material, such as spices. The package 10 comprises an open-topped container 12, a seal 14 mounted normally by snap-fitting, to the upper mouth of the container 12, and a double hinging cap 16 snap-locked to the seal.

The seal 14 includes a peripheral depending skirt 18 configured to frictionally engage and snap-lock to the slightly flared peripheral upper edge portion 20 of the container 12. The seal 14, conforms with the container 12 and is generally oblong with a pair of opposed raised platforms 22 and 24. The platform 22 has an enlarged port or opening 26 therethrough which can be used for pouring or spooning the product from the container 12, and might in fact also be used as a filling opening. The platform 24 presents a port in the form of multiple apertures 28 for a spinkling or sifting discharge of the container contents.

A transverse mounting platform 30 is defined transversely across the seal between the material discharge platforms 22 and 24 and is recessed relative thereto. Centrally of the mounting platform 30 is a pair of spaced centrally apertured vertically projecting bosses 32 with a transverse reinforcing rib 34 therebetween. The bosses 32 project slightly above the level of the two discharge platforms 22 and 24.

The cap 16 is formed as a unitary member from an appropriate thermoplastic resin such as polyethylene or polypropylene, providing a construction which, While relatively rigid, includes a degree of resiliency and the inherent capability of withstanding repeated flexing, without breakage, at hinge areas defined therein.

The cap 16 includes a pair of aligned longitudinally spaced closures or lids 36 and 38 respectively aligned over the seal platforms 22 and 24. The lid 36 includes a depending skirt 40 configured for frictional reception within the spooning opening 26 for a selective sealing thereof. The closure or lid 38 includes multiple depending protuberances 42 which nest within the sprinkling openings 28 and defined seals therefor. Two of the protuberances 42, preferably the outermost ones thereof, include depending posts 44 for a releasable snap-locking within a pair of the corresponding openings 28 as a closure retaining means. As an additional sealing feature, the cap 16 also includes a depending peripheral skirt 46 engagable peripherally about the platforms 22, 24 and 30. In order to provide both a tactile and a visual indication of the nature of the underlying port the lid 38 can be provided with surface depressions 43 formed in conjunction with the protuberances 42.

The closures or lids 36 and 38 are integrally interconnected by an inboard hinge strip 48 and a pair of opposed outboard spring or positioning strips 50, each separated from the inboard hinge strip by an elongate slot 52.

The inboard hinge strip 48 comprises a central hinge plate 54 integrally joined to the closures or lids 36 and 38 by a pair of integrally molded or formed hinges 56 in parallel relation to each other spaced longitudinally of the cap 16 and extending transversely thereof.

The outboard spring strips or positioning strips 50 each include a central plate 58 integrally joined to the opposed closures or lids 36 and 38 by a pair of hinges 60 paralleling the hinge strip hinges 56 in closely spaced longitudinally outward relation thereto. The dimension of each outboard strip central plate 58, in the longitudinal direction of the cap 16, is greater than that of the central hinge plate 54. It will also be noted that the oblong central portion of the cap 16 is elevated, defining a platform with the corresponding inboard hinge strip 48 in an upwardly spaced parallel plane to the plane of the two outboard positioning strips 50.

In each instance, the hinges 56 and 60 are formed by an appropriate reduction in the thickness of the material, normally effected in the molding process and in a manner known in the art.

The actual mounting of the cap 16 on the seal 14 is effected by a pair of depending lugs or studs 62 integrally formed with and depending from the hinge plate 54 for snap-locking within the apertured bosses 32 of the seals 14. If a permanent mounting of the cap 16 is desired, the lower ends of the studs 62 can be deformed after engagement through the apertured bosses 32. When mounted, the opposed closures 36 and 38 are individually manipulable between a port closing planar position and a port opening upwardly hinged position as will be noted in particular in FIGS. 9–12. Actual manipulation of the lids can be facilitated by an appropriate projecting edge lip or flange 64 at the longitudinally outer edge portion of each lid.

Figure 5:
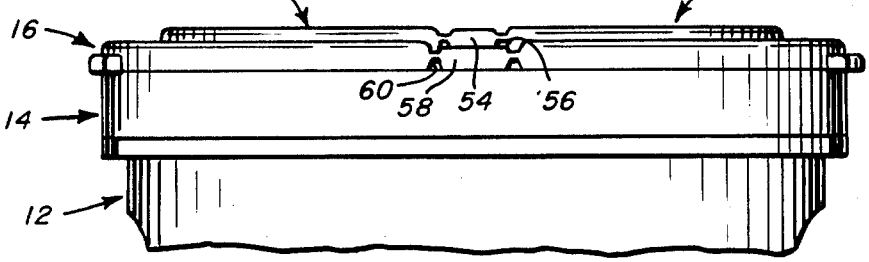
FIG. 5 is a side elevational view of the container mounted cap.
Figure 6:
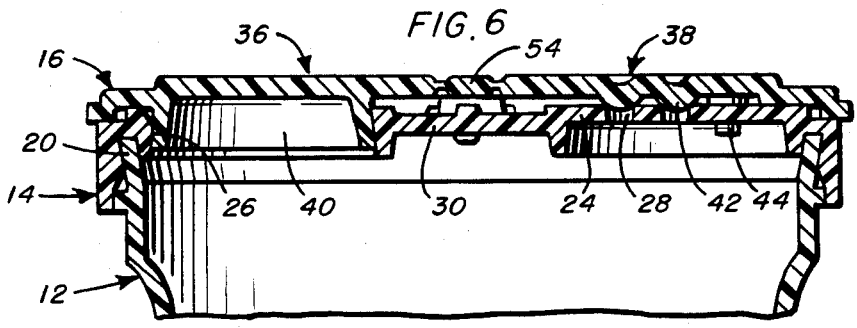
FIG. 6 is a longitudinal cross-sectional view taken substantially on a plane passing along line 6—6 in FIG. 4.
Figure 7:
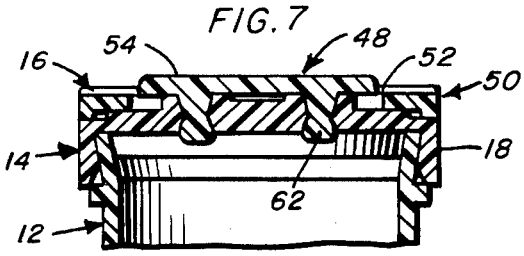
FIG. 7 is a transverse cross-sectional view taken substantially on a plane passing along line 7—7 in FIG. 4.
Figure 8:
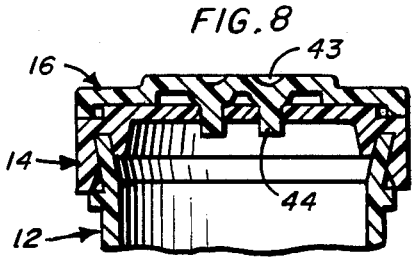
FIG. 8 is a transverse cross-sectional view taken substantially on a plane passing along line 8—8 in FIG. 4.
Figure 9:
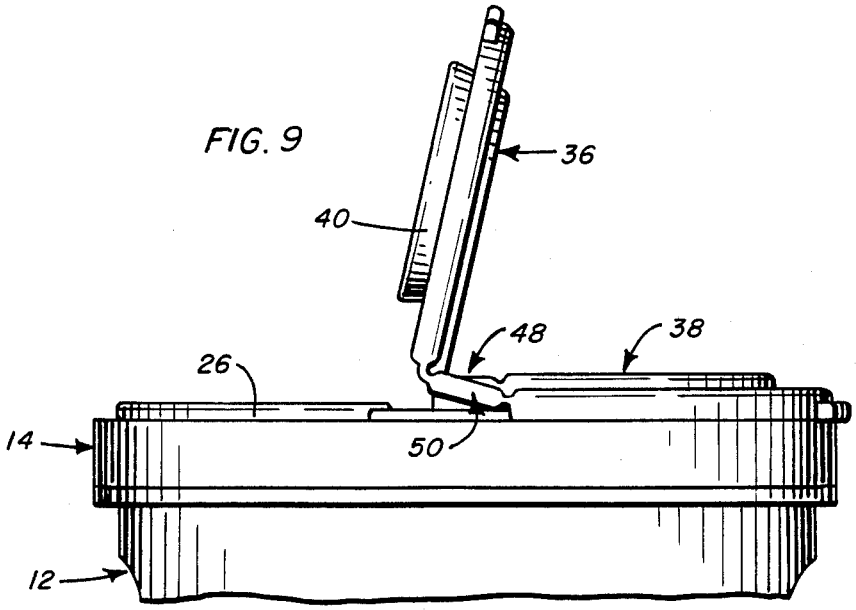
FIG. 9 is a view similar to FIG. 5 with one of the closures in its upwardly pivoted open position.
Figure 10:
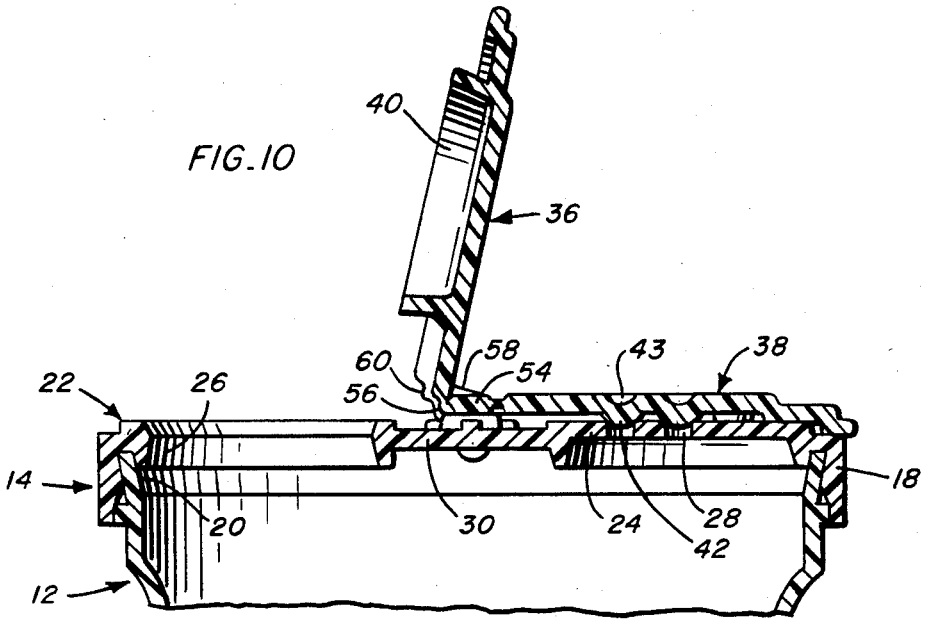
FIG. 10 is a longitudinal cross-sectional view with the closure upwardly pivoted as in FIG. 9.
Figure 11:
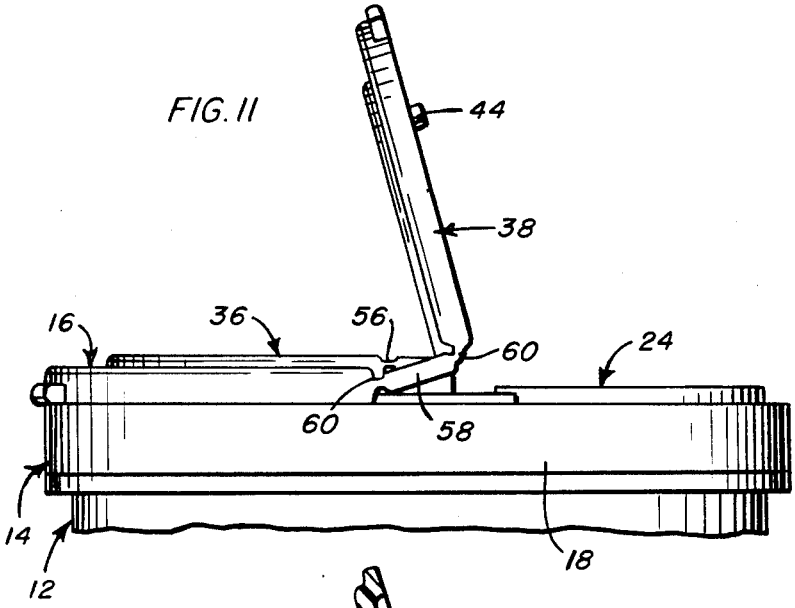
FIG. 11 is a side elevational view with the second closure upwardly pivoted.
Figure 12:
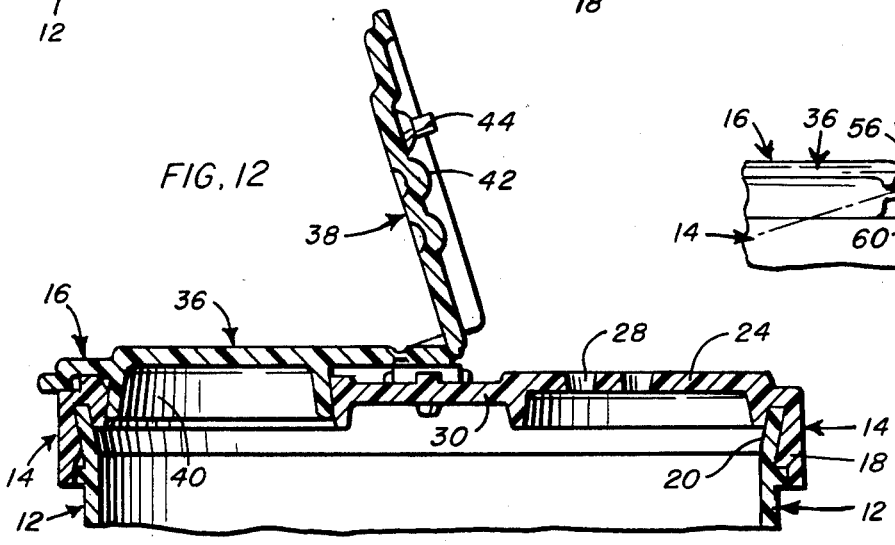
FIG. 12 is a longitudinal cross-sectional view with the second closure upwardly pivoted as in FIG. 11.

With regard to the manner of manipulation of the cap 16, and more particularly the dual closures or lids 36 and 38, it will initially be noted that the lids 36 and 38, in the closed positions thereof as illustrated in FIGS. 1, 5 and 6, are in a stable position with the inboard hinge strip 48 and outboard positioning or spring strips 50 in vertically offset parallel planes. Upon an upward pivoting of either lid, 36 or 38, to the open position thereof, as noted in FIGS. 9–12, the lid will hinge about an axis defined by the immediately adjacent hinge strip hinge 56. The central hinge plate 54, by which the cap 16 is mounted, remains in a stable fixed position paralleling the seal 14.

Figure 13:
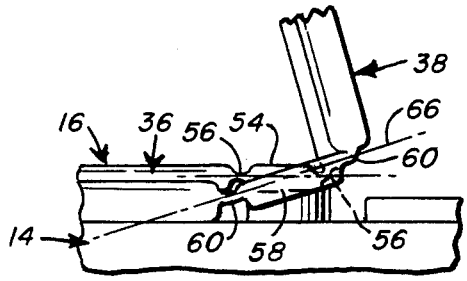
FIG. 13 is a schematic detail illustrating the hinge relationship whereby overcenter locking is achieved.

With continued reference to FIGS. 9–12, and with particular attention to FIG. 13, as the lid, either 36 or 38, is upwardly hinged or pivoted about the axis of the proximal hinge strip hinge 56, each of the positioning strips, through the associated hinges 60 and the inherent resiliency of these hinges in particular, is upwardly offset to an overcenter position relative to the folded hinge strip hinge 56. In so moving, the hinges 60 of each of the spring strips or positioning strips 50 cooperate. The hinges 60 proximal to the moved lid fold at an angle substantially equaling the angle of the corresponding hinge strip hinge 56 with the common axis of these proximal positioning strip hinges 60 being upwardly offset above the axis of the corresponding hinge strip hinge 56. At the same time, the remote or distal hinges 60 of the positioning strips 50 cooperate to allow for a slight upward pivoting of the central plates 58 of the positioning strips 50 about an axis paralleling the axis of the proximal strip hinges 60. Noting FIG. 13 in particular, in so folding about the parallel axes defined by the positioning strip hinges 60, the positioning strips 50 assume an upwardly angled overcenter position, designated by the dash line 66, which biases the folded lid to its upwardly swung open position whereby a positive manual movement of the lid would be necessary to move the lid to its closed or at rest position.

It is considered of particular significance that the paired hinges 60 of each spring strip 50, laterally spaced from each other in a longitudinal direction along the cap, cooperatively function to provide for a biasing of each of the lids, alternatively functioning as either a primary hinge folding to conform to the full folding movement of the corresponding lid, or as a secondary hinge folding only sufficient to accommodate the upward movement of the fully folded hinge above the primary hinge strip hinge 56 to an upwardly offset overcenter position. Thus, the dual hinges 60 on eacn of the positioning strips 50 provide dual functions, in each instance in cooperation with each other with the particular function of the hinge determined by which of the two closures or lids 36 or 38 is being manipulated. As previously indicated, the actual spring-lock function of the positioning strips 50 is achieved by the provision of the strips 50 in a plane parallel to and below the plane of the hinge strip 48 with the positioning strip hinges 60 being parallel to and longitudinally outward of the corresponding hinge strip hinges 56. The slots 52 which separate the inboard hinge strip 48 from the outboard positioning strips 50 extend, in each instance, longitudinally beyond the hinge strip hinges 56 and terminate at the longitudinal outer extremities of the positioning strip hinges 60.

It is to also be appreciated that the relationship of the positioning strips 50 to the inboard hinge strip 48 is such whereby as each open closure or lid is moved toward the closed position, the axes of the associated primary or fully folded positioning strip hinges 60 will, through a pivoting of the corresponding central plates 58 of the positioning strips 50, move vertically downward below the corresponding hinge strip hinge 56 and thus assume a lower overcenter position which will result in a biasing of the pivoted lid to its horizontal or closed position on the container seal 14. In this manner, the inherent biasing action of the positioning strips 50 will enhance the engagement of the lids with the seal. Further, the parallel vertically offset relation between the inboard hinge strip and the outboard positioning strips tend to provide offset stabilizing forces which in turn result in a stable horizontal positioning of the cap 16 until physically manipulated.

From the foregoing, it will be apprecited that a unique dual lid cap has been defined wherein each lid is mounted for pivotal movement between open and closed positions and selectively biased into said positions by an overcenter arrangement of associated positioning strips. The positioning strips, through a pair of cooperating hinges, are operative to bias either lid through the dual functionality of the cooperating hinges and without necessitating duplicate single function components.

What is claimed is:

1. In a container cap construction, first and second closure lids positionable in longitudinally aligned relation over said container, first and second spaced parallel hinges respectively mounting said first and second lids for independent hinged movement of said lids about parallel axes spaced longitudinally between said lids, and a spring strip extending between said lids, said spring strip including first and second pivot axes respectively joining the spring strip and the first and second lids, said pivot axes alternatively defining proximal and distal pivot axes relative to the first and second closure lids, said first and second pivot axes paralleling said first and second hinges respectively, each of said first and second pivot axes being disposed in longitudinally outwardly spaced relation to a respective one of said first and second hinges, said first and second hinges being in a common plane, said first and second pivot axes being offset to a first side of the plane when both closure lids are in a first hinged position, and said proximal pivot axis, upon hinged movement of either closure lid to a second hinged position, moving through and to the second side of the plane to an overcenter position biasing the moved lid to said overcenter position with the distal pivot axis remaining to the first side of the plane.

2. The cap construction of claim 1 including a hinge strip between said first and second closure lids, said hinge strip including a central hinge plate and said first and second spaced hinges, said closure lids, and hinge plate being integrally formed.

3. The cap construction of claim 2 wherein said spring strip is spaced laterally outward of said hinge strip and is integrally formed with said closure lids.

4. The cap construction of claim 3 including a second spring strip duplicating said first mentioned spring strip, said hinge strip being in inwardly spaced relation between said spring strips.

5. A unitary cap for a container comprising two longitudinally aligned closure lids, first and second hinge means for pivotally mounting said lids for selective movement between open and closed positions about a pair of spaced hinge-defined axes between said lids, said hinge-defined axes being in a first plane, a spring strip extending longitudinally between said closure lids and integrally pivoted thereto at a pair of pivot axes, each of said pivot axes being parallel to and spaced longitudinally outward of one of said hinge-defined axes, said pivot axes, in a closed position of the lids, being in a second plane offset in the direction of said container from said first plane, said pivot axes being shared by said lids and providing reverse functions with respect to the closure lids with each pivot axis alternatively defining a proximal pivot axis for one lid and a distal pivot axis for the other lid, whereby said two closure lids are alternatively movable about a corresponding hinge axis with the spring strip pivoting about the distal pivot axis and with the proximal pivot axis moving from one side to the other of the plane of the hinge-defined axes to an overcenter position relative to the hinge axis of the moved closure lid.

6. A one-piece container cap comprising a pair of longitudinally aligned closure lids, a hinge strip extending longitudinally betwen said closure lids, said hinge strip including a pair of longitudinally spaced parallel hinges integrally joining said closure lids to said hinge strip and defining a pair of hinge axes, a spring strip extending longitudinally of said cap in parallel spaced relation to s aid hinge strip, said spring strip including a pair of longitudinally spaced parallel hinges integrally joining said spring strip to said closure lids, each of said spring strip hinges being disposed longitudinally outwardly of one of said hinge axes, said spring strip hinges defining pivot axes, said hinge strip and said spring strip being in spaced adjacent planes when said closure lids are in a closed position.

7. The container cap of claim 6 including a second duplicate spring strip in parallel spaced relation to said hinge strip to the opposite side thereof from said first mentioned spring strip.

8. The container cap of claim 7 wherein each said closure lid is pivotable about the associated hinge axis between a closed position in a common plane with the other lid and an open position extending laterally to one side of the common plane of the closed lids.

9. The container cap of claim 8 wherein, in the closed position of said lids, said hinge strip and said spring strips are in substantially parallel offset planes.

10. The container cap of claim 9 wherein said hinge strip includes a substantially rigid central hinge plate, said hinge plate including means for mounting said central hinge plate in fixed position relative to a container.

11. The container cap of claim 10 wherein each of said spring strips includes a substantially rigid central panel between the spring strip hinges.

12. For use in the selective dispensing of flowable material from a container through either of two ports therein, a unitary cap comprising a pair of longitudinally aligned lids, a pair of hinges mounting said lids for alternate pivotal movement, about a pair of parallel hinge axes, between closed positions closing corresponding ports and open positions opening the ports, said hinge axes extending across said cap between said lids, and overcenter positioning means extending between and integral with said lids for selectively biasing each lid in the open and closed position thereof, said positioning means being integral with said lids and comprising a substantially rigid strip with opposed ends integrally hinged to said lids and defining said pair of hinge axes, one pivot axis associated with each lid and being disposed longitudinally outward of and adjacent the associated hinge axis for pivotal attachment of a spring strip to said lids, said hinge axes defining a plane, each lid, upon movement to the open position thereof, extending laterally to one side of said plane, said pivot axes, in the closed position of the lids, being positioned on the opposite side of said hinge axis plane with each pivot axis crossing the hinge axis plane to an overcenter position upon movement of the corresponding lid to the open position thereof, said spring strip, with one of said lids in the open position, extending through said hinge axis plane with one of said pivot axes disposed on each side of said plane.

13. For use with a container having a discharge end for flowable material, a container cap comprising a generally flat elongate member having opposed end portions forming a pair of longitudinally outwardly directed closure lids, a pair of elongate slots extending longitudinally of said member in parallel spaced relation between said lids, said slots defining an inboard hinge strip therebetween and a pair of outboard spring strips, one spring strip being disposed laterally outward of each slot, said hinge strip being in a first plane, said spring strips being in a second plane substantially parallel to and in spaced adjacent relation to said first plane to a first inner side thereof in proximity to said container, said inboard hinge strip including a pair of spaced hinges extending across said inboard hinge strip to said lids, said spring strips each including a pair of spaced pivot axes integrally joining said spring strips to said lids, each of said pivot axes being parallel to a hinge strip hinge in adjacent relation thereto and spaced outwardly of said hinge strip hinge along the length of said elongated member, said hinge strip including a substantially rigid panel between said hinges, and means on said panel for mounting said panel in a fixed position relative to the discharge end of a container, whereby each said lid hinges outward to a second outer side of the plane of the hinge strip, each of said spring strips, upon outward hinged movement of either lid, pivoting about both pivot axes with the pivot axis associated with the moved lid moving to an overcenter retaining position by translational movement from said first inner side of said plane of the hinge strip to the second outer side of the plane of the hinge strip.

* * * * *